US008328049B1

(12) United States Patent
Murrieta

(10) Patent No.: US 8,328,049 B1
(45) Date of Patent: Dec. 11, 2012

(54) MEDICAL PATIENT ORAL HYDRATION SYSTEM

(76) Inventor: Eugene Murrieta, Incline Village, NV (US)

( * ) Notice: Subject to any disclaimer, the term of this patent is extended or adjusted under 35 U.S.C. 154(b) by 0 days.

(21) Appl. No.: 12/762,151

(22) Filed: Apr. 16, 2010

Related U.S. Application Data

(60) Provisional application No. 61/175,673, filed on May 5, 2009.

(51) Int. Cl.
*B65D 35/56* (2006.01)

(52) U.S. Cl. ..... 222/105; 222/110

(58) Field of Classification Search ..... 604/132, 604/18; 239/333; 222/105, 110
See application file for complete search history.

(56) References Cited

U.S. PATENT DOCUMENTS

| | | | | |
|---|---|---|---|---|
| 3,895,631 | A * | 7/1975 | Buckles et al. | 604/132 |
| 4,318,400 | A * | 3/1982 | Peery et al. | 604/18 |
| 5,645,404 | A * | 7/1997 | Zelenak | 417/1 |
| 6,401,997 | B1 * | 6/2002 | Smerdon, Jr. | 224/414 |
| 2004/0045980 | A1 * | 3/2004 | Robins | 222/63 |

* cited by examiner

*Primary Examiner* — Kevin C Sirmons
*Assistant Examiner* — Brandy C Scott
(74) *Attorney, Agent, or Firm* — Lewis and Roca LLP

(57) ABSTRACT

An oral hydration system includes a holster configured to be mounted to a mounting structure. A hydration liquid bladder is removably disposed in the holster. A feed tube has a proximal end communicating with the hydration liquid bladder. A backflow-prevention bite valve is coupled to a distal end of the feed tube.

7 Claims, 3 Drawing Sheets

MEDICAL PATIENT ORAL HYDRATION SYSTEM

CLAIM FOR PRIORITY

This application claims the benefit of U.S. Provisional Patent Application Ser. No. 61/175,673, filed on May 5, 2009, the entirety of which is incorporated by reference herein.

BACKGROUND

1. Field of the Invention

The present invention relates to oral hydration systems for medical patients. More particularly, the present invention relates to an oral hydration system including a hydration water bladder with a holster and semi rigid boom, and a feed tube terminated in a backflow-prevention bite valve.

Assuring that patients are sufficiently hydrated is a necessary part of medical care. Many patients have limited or no use of their arms, and are thus unable to hold a cup and/or a straw from which to drink. These patients must rely on another person to hold the cup for them. There is a significant danger that such patients may become dehydrated. Some patients can also tend to spill the water or other liquid in the bed, necessitating changing of the bed linens.

2. Brief Description

An oral hydration system includes a hydration water bladder. The bladder includes a feed tube terminated in a backflow-prevention bite valve. The feed tube may be mounted in a semi-rigid conduit for a portion of its length. The bladder is mounted in a holster that may be affixed to the patient's bed or to a separate stand. The bladder or the holster may be provided with a volume scale so that the patient's oral fluid intake can be monitored.

BRIEF DESCRIPTION OF THE DRAWING FIGURES

DETAILED DESCRIPTION

Those of ordinary skill in the art will realize that the following description of the present invention is illustrative only and not in any way limiting. Other embodiments of the invention will readily suggest themselves to such skilled persons.

Figure 1:
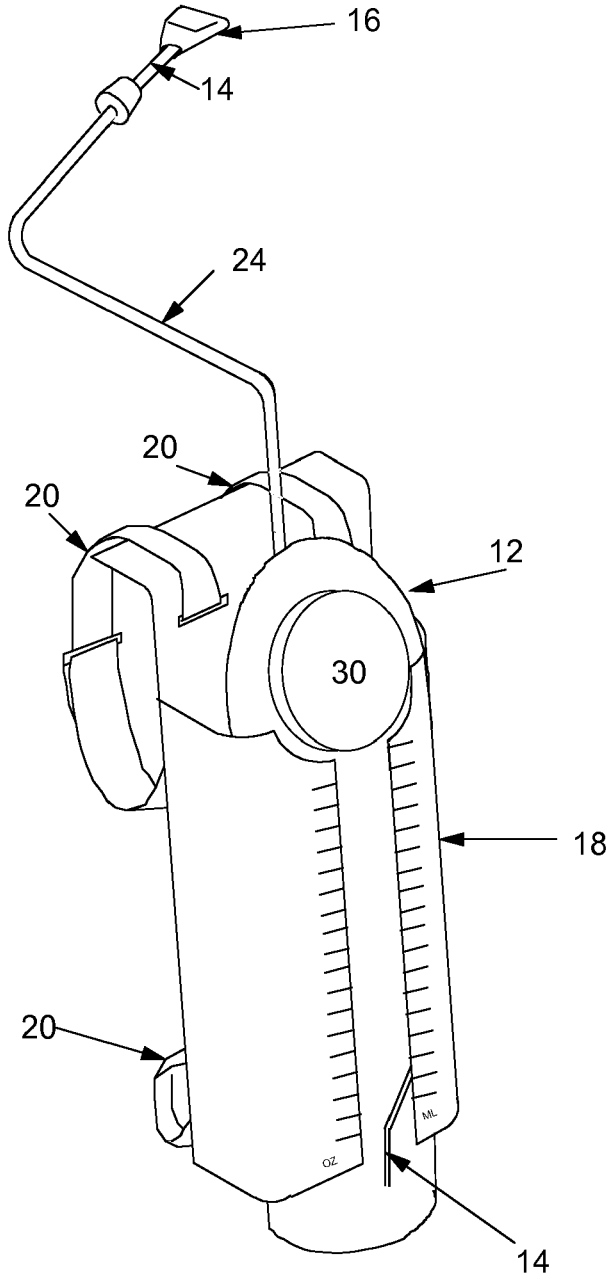
FIG. 1 is a diagram showing an illustrative patient hydration system in accordance with the present invention.
Figure 2:
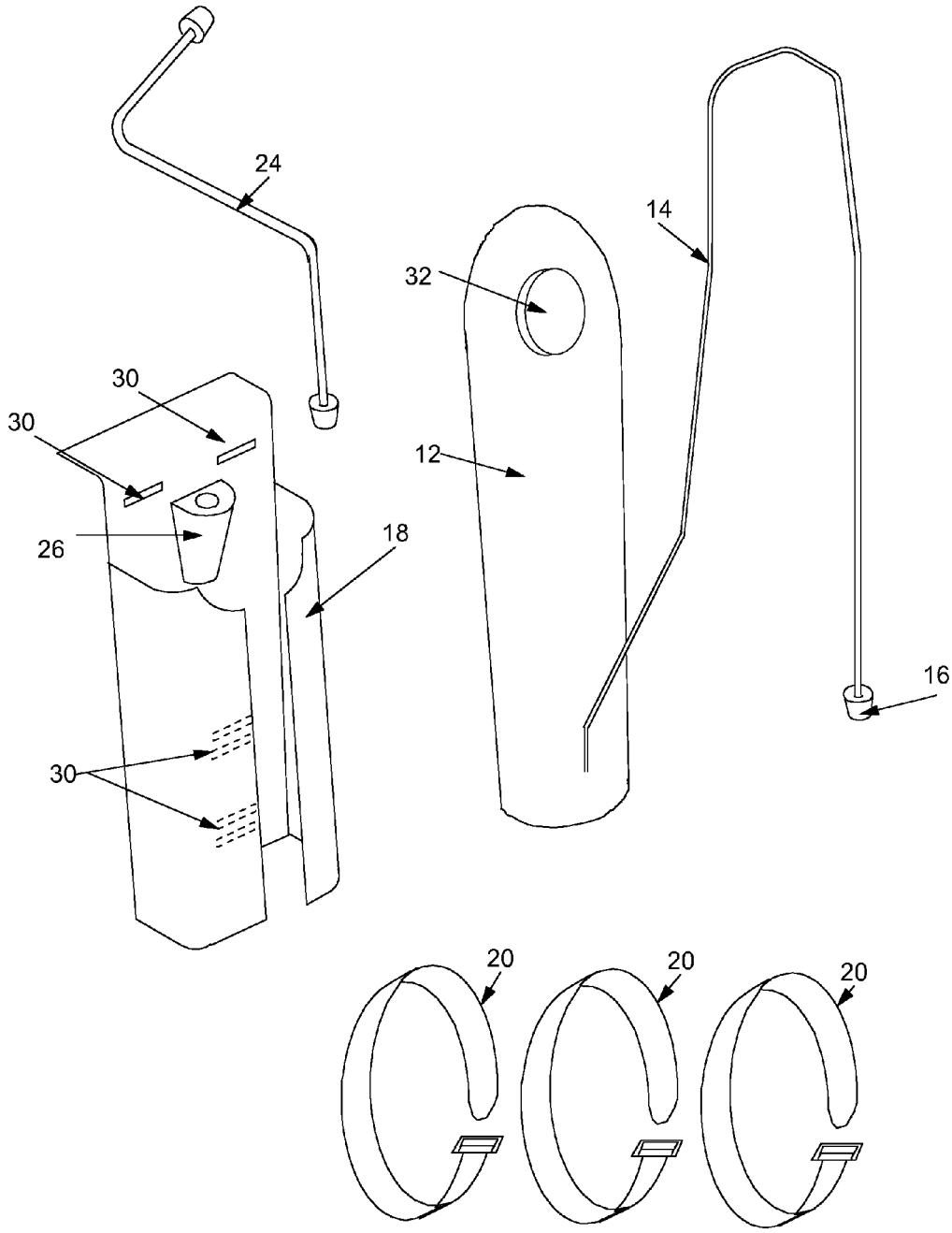
FIG. 2 is a diagram showing typical components of an illustrative patient hydration system in accordance with the present invention.

Referring first to FIGS. 1 and 2, diagrams show an illustrative patient hydration system in accordance with the present invention in an assembled an unassembled configuration, respectively. The patient hydration system 10 according to one aspect of the present invention includes a hydration bladder 12. Bladder 12 may be a commercially-available bladder available from a plurality of sources including Camelbak of Petaluma, Calif.

Hydration bladder 12 is coupled to a feed tube 14 terminating in a backflow-prevention bite valve 16. Feed tube 14 may be formed from medical grade plastic tubing. Bite valve 16 may be a valve such as one manufactured by Camelbak of Petaluma, Calif.

Bladder 12 is inserted into a hydration bladder holster 18, which may be formed or molded from a suitable material such as a plastic material. In use, the hydration bladder holster 18 containing the hydration bladder 12 may be attached to the side guardrails of a hospital bed or may be affixed to other structures such as an IV pole, a wheelchair or the like for convenience of the hospital staff. The exemplary embodiment of FIG. 1 shows holster 18 equipped with three hook-and-loop fastener straps 20

FIG. 1 shows holster 18 provided with a volume scale so that the patient's oral fluid intake may be monitored. Persons of ordinary skill in the art will readily appreciate that the volume scale could alternatively be disposed on the bladder 12.

Figure 3:
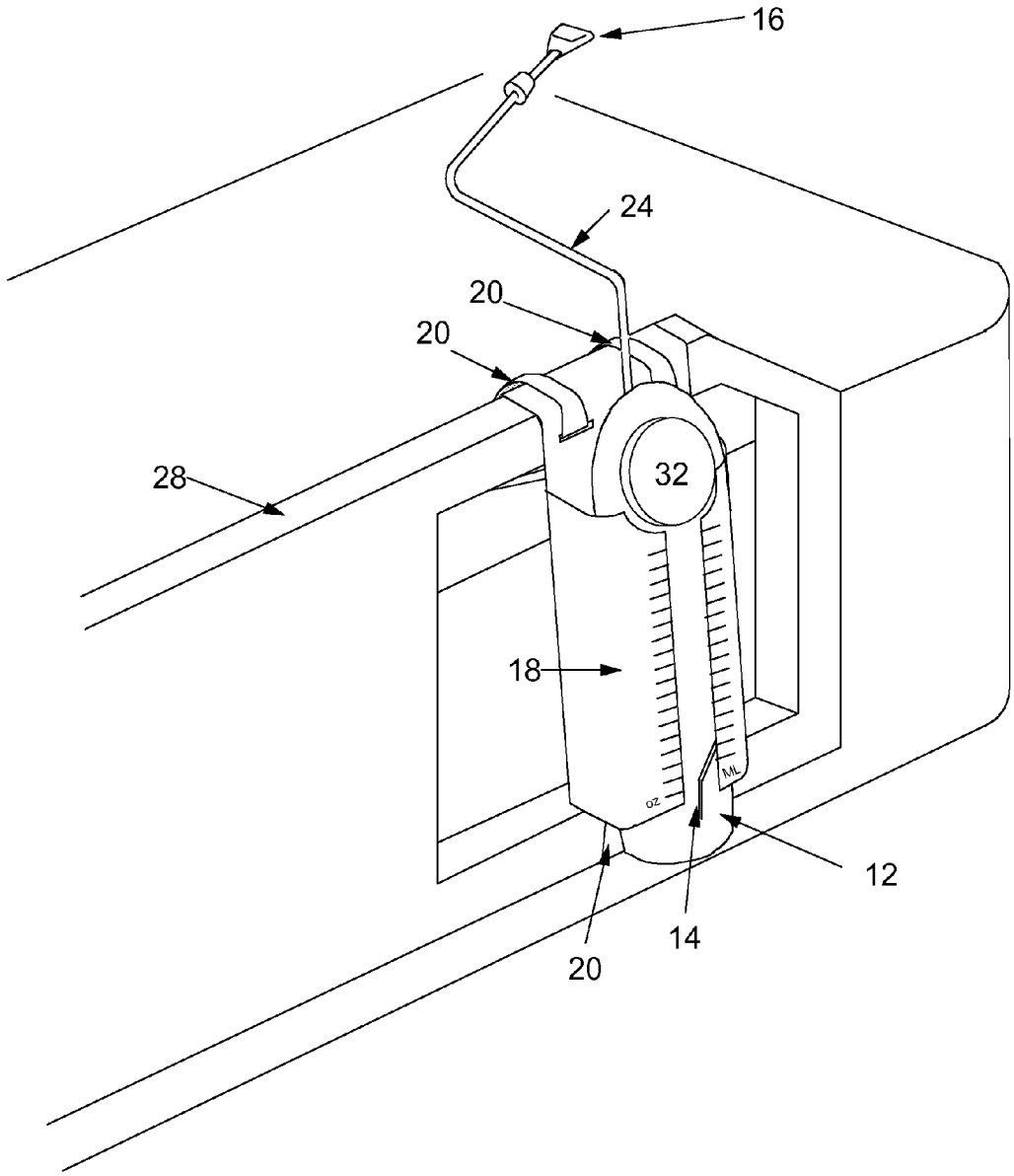
FIG. 3 is a diagram showing an illustrative patient hydration system affixed to a patient bed in accordance with the present invention.

Feed tube 14 may run through a semi-rigid boom (conduit) 24. The semi rigid boom 24 may be formed from a material such as metal or plastic and attaches to the holster 18 by means of threads, friction fit, or other fastening modality. By way of illustration, a mounting block 26 for mounting semi-rigid boom 24 is shown in FIG. 3. Semi-rigid boom 24 holds its position/shape, acting as a conduit for the feed tube 14. Semi-rigid boom 24 allows positioning the feed tube 14 to extend out over the bed so it may be positioned proximately to the patient's mouth.

Only the feed tube 14 and bite valve 16 directly contacts the fluid passing therethrough. The bite valve 16 closes when not being used, keeping the water or other liquid from flowing back into the bladder 12. To activate the bite valve 16, the patient squeezes it with his or her lips and sips water or other liquid as needed.

Referring now to FIG. 3, a diagram shows an illustrative patient hydration system affixed to a patient bed in accordance with the present invention. Bladder holster 18 is held to the side rails 28 of the hospital bed using hook-and-loop fastener straps 20 that mount through slots 30 in holster 18. Persons of ordinary skill in the art will appreciate that other fastening means may be used to affix holster 18 to the bedrails 28. Such skilled persons will also appreciate that holster 18 may be hung or attached from some other mounting structure, such as an IV pole (not shown). Bladder 12 includes filler cap 32 to allow filling the bladder 12 with a hydrating liquid such as water.

In use, the holster 18 with hydration bladder 12 in it is attached, for example, to the side guardrail 28 of the hospital bed. The semi rigid boom 24 is attached to the holster 18. The bladder is then filled with water. The semi rigid boom 24 is positioned to extend out over to a position proximate to the patient's mouth. The patient can lean forward or bring the bite valve into his or her mouth and sip water or other liquid from the feed tube.

The oral hydration of medical patients according to the present invention without the use of an I.V. or cup and straw allows patient to squeeze the bite valve with his or her lips and sip water as needed. Proper hydration of patients encourages faster patient recovery. Using the present invention, the water or other liquid will not spill, thus saving time and labor for the changing of bed linens. This reduces staff time to administer water for hydration, eases the monitoring of patient oral liquid consumption over a given time.

While illustrative embodiments of the present invention have been shown, persons skilled in the art will realize that other embodiments employing the inventive principles disclosed herein are possible, and such embodiments will readily suggest themselves to such skilled persons. Thus the invention should only be limited within the spirit of the claims.

What is claimed is:

1. An oral hydration system including: a holster configured to be mounted to a mounting structure; a hydration liquid bladder removably disposed in the holster; a feed tube having a proximal end communicating with the hydration liquid bladder; a backflow-prevention bite valve coupled to a distal end of the feed tube; and a boom formed from a self-supporting semi-rigid conduit formed from a plastic or metal material and directly attached to a mounting block on the holster, wherein at least a portion of a length of the feed tube is disposed in the semi-rigid conduit for a continuous portion of its length.

2. The oral hydration system of claim 1, further including a fluid-volume scale disposed on the holster.

3. The oral hydration system of claim 1, further including a fluid-volume scale disposed on the hydration liquid bladder.

4. The oral hydration system of claim 1, wherein the holster is configured to be mounted to the mounting structure by at least one strap.

5. The oral hydration system of claim 4, wherein the holster is configured to be mounted to the mounting structure by straps.

6. The oral hydration system of claim 1, wherein the holster is formed from a plastic material.

7. The oral hydration system of claim 1 wherein the holster is formed from a molded plastic material.

* * * * *